US006239768B1

(12) United States Patent
Oh et al.

(10) Patent No.: US 6,239,768 B1
(45) Date of Patent: May 29, 2001

(54) DUAL BAND RETRACTABLE ANTENNA SYSTEM WITH CAPACITIVE COUPLING

(75) Inventors: Jeong Kun Oh; Kyung Min Lee, both of Kyunggi-do; Duk Jae Park, Incheon-shi; Choong Ki Cho, Incheon-shi; Jung Mi Park, Incheon-shi, all of (KR)

(73) Assignee: ACE Technology, Kyunggi-Do (KR)

( * ) Notice: Subject to any disclaimer, the term of this patent is extended or adjusted under 35 U.S.C. 154(b) by 0 days.

(21) Appl. No.: 09/329,362

(22) Filed: Jun. 10, 1999

(30) Foreign Application Priority Data

Jun. 11, 1998 (KR) ..... 98-21767

(51) Int. Cl.[7] ..... H01Q 1/24
(52) U.S. Cl. ..... 343/895; 343/702; 343/901
(58) Field of Search ..... 343/702, 895, 343/900, 901, 725, 727, 729; H01Q 1/24

(56) References Cited

U.S. PATENT DOCUMENTS 5,661,496 * 8/1997 Baek et al. ..... 343/702
5,754,141 * 5/1998 Thompson et al. ..... 343/702
5,969,684 * 10/1999 Oh et al. ..... 343/702
6,054,958 * 4/2000 Holshouser et al. ..... 343/702

* cited by examiner

*Primary Examiner*—Hoanganh Le
(74) *Attorney, Agent, or Firm*—Lowe Hauptman Gilman & Berner, LLP

(57) ABSTRACT

Dual band retractable antenna system with capacitive coupling includes a helical antenna for operating at stand-by mode, the helical having ¼ wavelength; a whip, which penetrates the helical, for operating at busy mode, the whip having ¼ wavelength; a stopper for catching the whip when the antenna is extended out; a sleeve mounted to one end of the helical, for operating as a feed point when the whip is extended out; a capacitive coupling arrangement placed between the helical and the sleeve, for capacitively coupling the helical to the sleeve; and a matching circuit connected between the sleeve and the antenna system, so that the antenna system operates for both frequency bands.

9 Claims, 6 Drawing Sheets

DUAL BAND RETRACTABLE ANTENNA SYSTEM WITH CAPACITIVE COUPLING

BACKGROUND OF THE INVENTION

1. Field of the Invention

The present invention relates to a dual band antenna system, more particularly to such an antenna system for use in a portable handheld communication device and which is operable both in an extended and retracted state.

2. Prior Art of the Invention

Portable handheld communication devices, such as a cordless phone, a cellular phone and a PCS (Personal Communications Service) phone, have become increasingly popular. The portable handheld communication devices should be compact and lightweight. It is known to design such a device with a whip antenna that is selectively retracted and extended. The user wishes to keep the device turned on so that a call can be received and the user be notified of such receipt, but at the same time retract the antenna into the case of the device so that the device can be placed in a pocket or purse. Therefore, there is a need for an antenna system operable in dual bands.

A retractable antenna system in accordance with known prior art comprises a ¼ wavelength whip and a helical antenna placed on top of the whip. The conventional antenna is illustrated in FIGS. 1A and 1B.

Referring to FIG. 1A and 1B, a sleeve 14 is mounted to the upper surface of an case 13. There is a distance between a ¼ wavelength whip 11 and a ¼ wavelength helical 12, thereby not affecting each other. This antenna system operates only as a ¼ wavelength helical antenna when the whip antenna is retracted into the case of the device, and operate only as a ¼ wavelength whip antenna when the whip antenna is extended out of the case.

When the antenna system is retracted into the case as illustrated in FIG. 1A, only helical section 12 operates. When the antenna system is extended out of the case as illustrated in FIG. 1B, a stopper 15 connected to one end of a whip section 11 is caught in the sleeve 14 and only the whip section 11 operates. The helical antenna 12 is electrically separated from the sleeve 14. This antenna system has problems in that the bandwidth of the helical antenna is narrow and radiation efficiency of the antenna is low. The connection point between the whip 11 and the helical 12 is weak, thereby easily breaking. Also, the antenna uses only single band.

SUMMARY OF THE INVENTION

Therefore, an object of the present invention is to provide an antenna system in which the bandwidth of the helical antenna is wide and the radiation efficiency thereof is improved.

Another object of the present invention is to provide an antenna system operating in the frequency band of 800 MHz and 1.8 GHz.

In accordance with an aspect of the invention, there is provided a dual band retractable antenna system, comprising a helical antenna for operating at stand-by mode, the helical having ¼ wavelength; a whip antenna, which penetrates the helical, for operating at busy mode, the whip having ¼ wavelength; a stopper for catching the whip when the antenna is extended out; a sleeve mounted to one end of the helical, for operating as a feed point when the whip is extended out; a capacitive coupling means placed between the helical and the sleeve, for capacitively coupling the helical to the sleeve; and a matching circuit coupled between the sleeve and the antenna system, so that the antenna system operates for both frequency bands.

BRIEF DESCRIPTION OF THE DRAWINGS

The above and other objects and features of the present invention will become apparent from the following description of preferred embodiments given in conjunction with the accompanying drawings, in which like elements in different figures thereof are identified by the same reference numeral and wherein.

DETAILED DESCRIPTION OF THE INVENTION

Figure 1A:
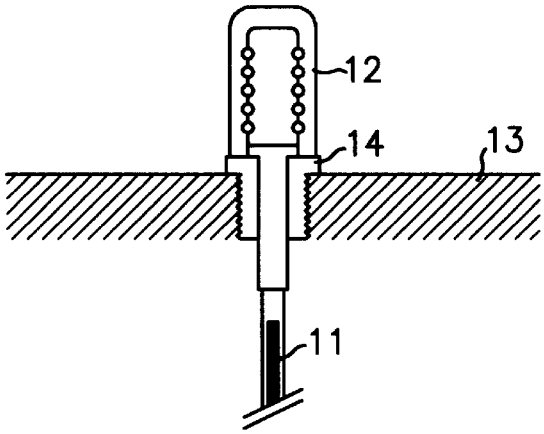
FIG. 1A (PRIOR ART)
FIGS. 1A and 1B are schematic cross sectional views of a retractable antenna when being retracted into and extended out in accordance with the prior art.
Figure 1B:
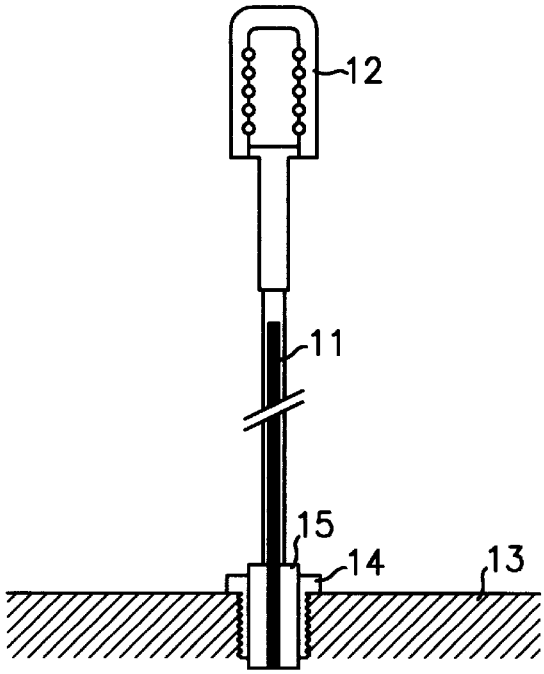
FIG. 1B (PRIOR ART)
Figure 2:
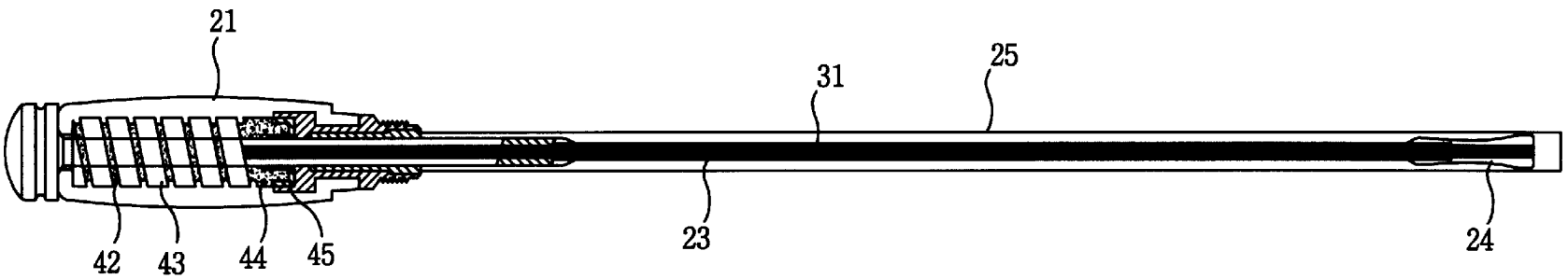
FIG. 2 is a schematic cross sectional view of a dual band retractable antenna with capacitive coupling method in accordance with the present invention.
Figure 3:
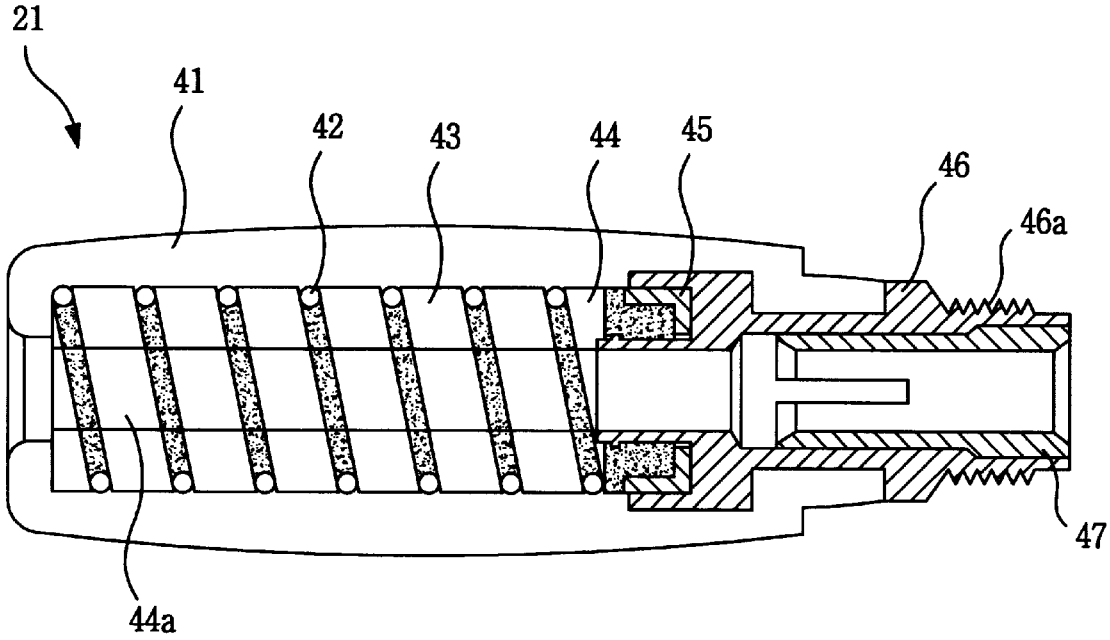
FIG. 3 is a cross sectional view of the helical in detail.

Referring to FIGS. 2 and 3, a dual band retractable antenna comprises a helical 21, a guide 25, a tube 23, a stopper 24 and a whip 31. The helical 21 having a ¼ wavelength operates at a call stand-by mode. One end of the guide 25 is inserted into the helical 21 and tied up. The retractable tube 23 is placed inside the guide 25, and one end of the tube 23 is tied up to the stopper 24.

The whip 31, of which one end is tied up to the stopper 24 and the other end penetrates the helical, operates as a transmission and receiving antenna at a busy mode. In this embodiment, the whip 31 is made of a high elastic material such as a Nickel-Titanium alloy, thereby being possible to improve endurablity and restoration ability of the antenna.

The helical 21 comprises a cover 41 (FIG. 3) of which one end is connected to sleeve 46. The sleeve 46, in which thread 46*a* of a screw is formed on the circumference of one end of the sleeve 46, is fixed into the case of the phone and operates as a feed point of the antenna. A plate spring 47 is mounted in one hollow and of the sleeve 46 so that the stopper 24 is caught in the plate spring and supported when the antenna is extended out.

A second insulator 45 is positioned in the other end of the sleeve 46. A metal plate having a predetermined length 44 is mounted on the second insulator 45. The sleeve 46 is capacitively coupled to the metal plate 44 through the medium of the second insulator 45.

The metal plate 44 is coupled to a first insulator 43 on which helical grooves are formed. Coil is coiled up the grooves formed on the circumference of the first insulator 43. The coil is connected the metal plate 44.

Figure 4A:
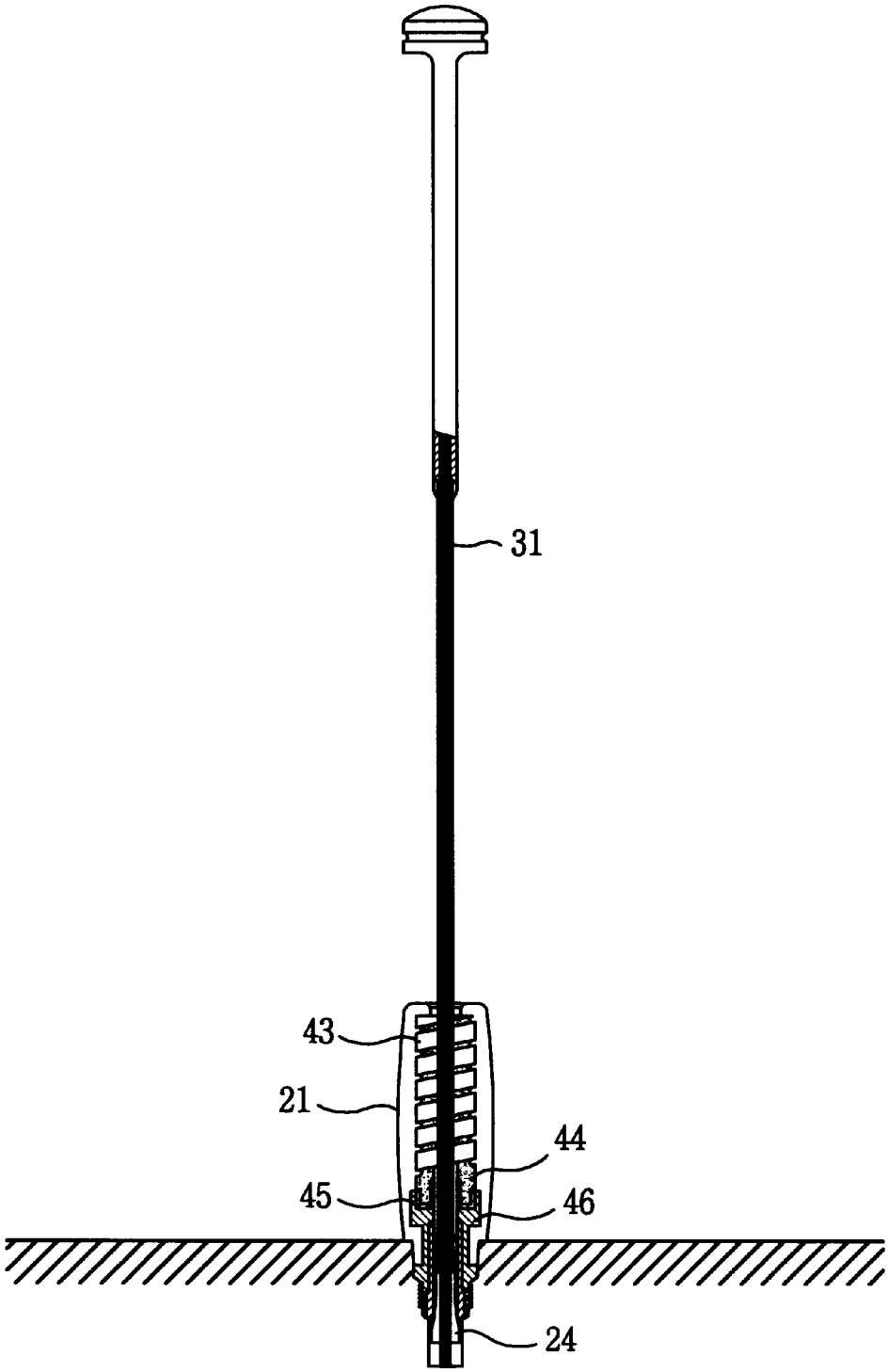
FIG. 4A and 4B are views of the dual band retractable antenna when being retracted into and extended out in accordance with the present invention.

Referring to FIG. 4A, a point between the sleeve 46 and the stopper 24 operates as a feed point, and the whip 31 operates as a transmitting and receiving antenna when the antenna is extended out. At this time, the sleeve 46 is capacitively coupled to the metal plate 44 through the second insulator 45, and then the helical 21 is coupled to the lower part of the whip 31.

Figure 4B:
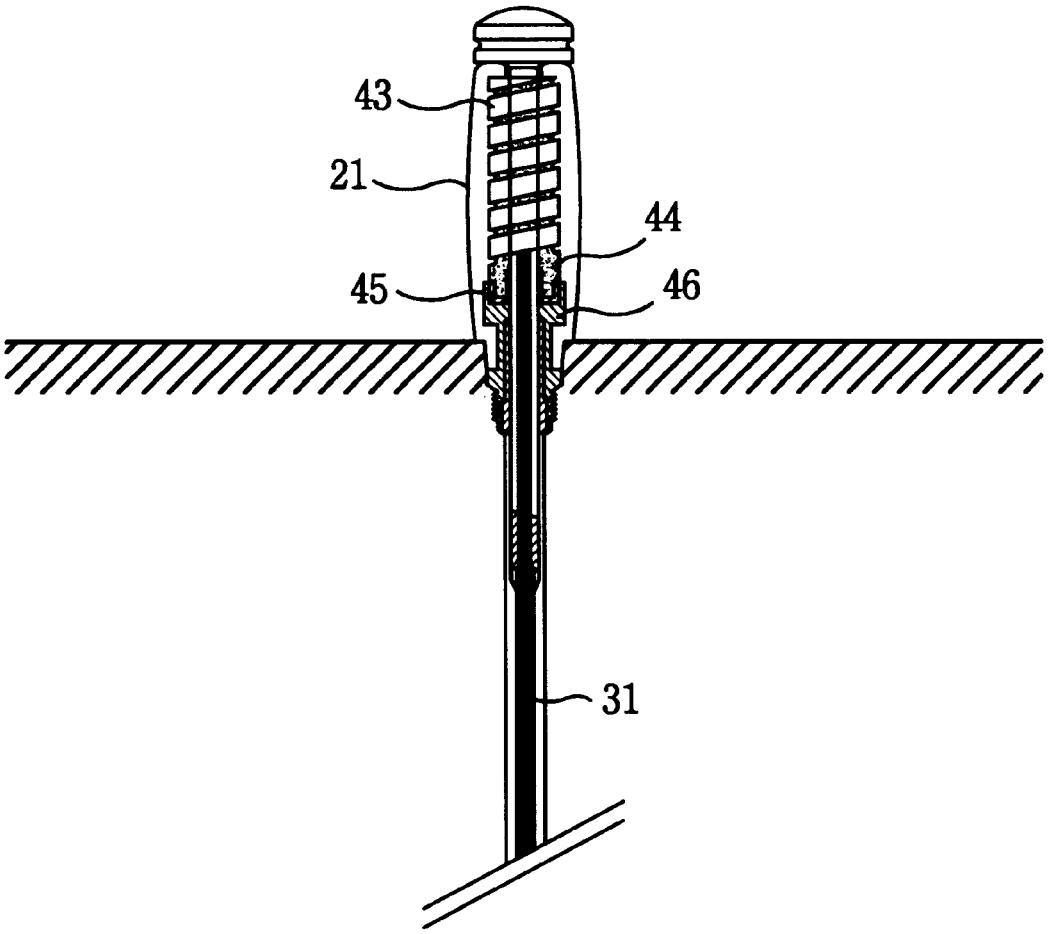

Referring to FIG. 4B, the whip 31 is capacitively coupled to the tube 23 through the tube when the antenna is retracted, and then the helical 21 operates as the antenna. The capacitive coupling between the sleeve 46 and the metal plate 44 allows the capacity of the helical to be increased, thereby the bandwidth of the helical antenna being wide. Therefore, eletric characteristics of the antenna system is stabilized.

Figure 5A:
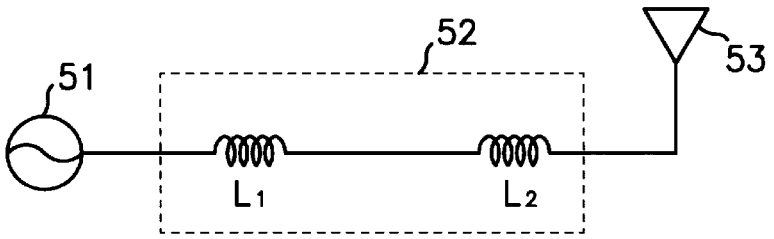
FIG. 5A is a circuit diagram of matching circuit of the dual band retractable antenna in accordance with the present invention.
Figure 5B:
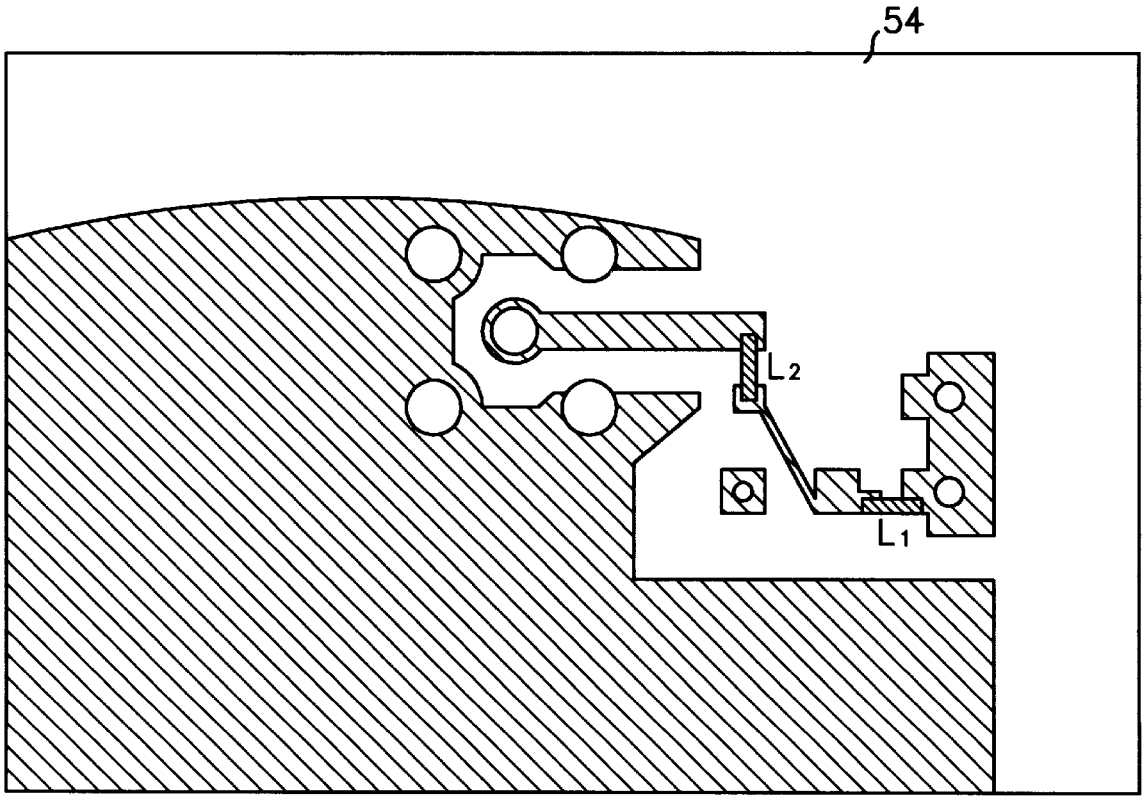
FIG. 5B is PCB layout of FIG. 5A.

Referring to FIGS. 5A and 5B, there is a matching circuit 52 between a feed point 51 and the antenna system. The matching circuit 52 is mounted on the printed circuit board 54 in the body of the phone (not shown). The matching circuit 52 comprises two inductors L1 and L2. In this embodiment, values of the inductors are 7.1 nH and 1.5 nH. The antenna system simultaneously operates in the dual frequency band of 800 MHz (for cellular communication) and 1.8 GHz (for PCS).

Although the preferred embodiment of the invention have been disclosed for illustrative purpose, those skilled in the art will appreciate that various modification, addition and substitutions are possible, without departing from the scope and spirit of the invention as disclosed in accompanying claims.

What is claimed is:

1. A dual band retractable antenna system, comprising;

a helical antenna for operating in a stand-by mode, said helical having a ¼ wavelength;

a whip antenna which extends into and penetrates said helical, for operating in a busy mode, said whip having a ¼ wavelength;

a stopper for catching said whip when said whip is extended out;

a sleeve mounted to one end of said helical for operating as a feed point;

a capacitive coupling arrangement placed between said helical and said sleeve, for capacitively coupling said helical to said sleeve; and a matching circuit connected between said sleeve and said antenna system, so that said antenna system operates for both frequency bands.

2. The dual band retractable antenna system as claimed in claim 1, wherein said capacitive coupling arrangement comprises:

a metal conductor in said helical; and a first insulating means mounted in one end of said sleeve, for leading capacitive coupling by performing insulation between said sleeve and said metal conductor.

3. The dual band retractable antenna system as claimed in claim 1, wherein said matching circuit comprises two inductors in serial so that said antenna system operates for both 800 MHz (for cellular communication) and 1.8 GHz (for PCS) frequency bands.

4. The dual band retractable antenna system as claimed in claim 1, wherein said helical includes a cover connected at one end thereof to the sleeve, and said sleeve includes a thread formed at one end thereof for fixing said sleeve into a case of a phone, said sleeve operating as the feed point of the antenna system.

5. The system of claim 4, wherein said sleeve further includes a plate spring mounted in a hollow end of the sleeve so that the stopper is caught by the plate spring and supported thereby when the antenna is extended.

6. The system of claim 5, wherein a second insulator is positioned in the other end of the sleeve and a metal plate having a predetermined length is mounted on the second insulator, said sleeve being capacitively coupled to the metal plate through the second insulator.

7. The system of claim 6, wherein said metal plate is coupled to a first insulator on which helical grooves carrying said helical are formed, said coil of the helical being connected to the metal plate.

8. The system of claim 7, wherein a point between the sleeve and the stopper operate as a feed point and the whip operates as a transmitting and receiving antenna when the antenna system is extended; wherein, in the extended position of the antenna system, the sleeve is capacitively coupled to the metal plate through the second insulator and the helical is coupled to a lower part of the whip.

9. The system of claim 8, wherein the matching circuit is mounted on a printed circuit board formed in the body of the phone and the matching circuit comprises two inductors connected in serial with each other.

* * * * *